US006386911B1

(12) United States Patent
Biermann et al.

(10) Patent No.: US 6,386,911 B1
(45) Date of Patent: May 14, 2002

(54) BOARD MOUNTED CONNECTOR

(75) Inventors: Werner Biermann, Winterbach; Hans Kieninger, Stuttgart; Roland Schmid, Filderstadt; Wolfgang Drichelt, Schwaikheim, all of (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/664,978

(22) Filed: Sep. 18, 2000

(30) Foreign Application Priority Data

Sep. 22, 1999 (DE) ..... 199 45 310

(51) Int. Cl.[7] ..... H01R 13/73
(52) U.S. Cl. ..... 439/571
(58) Field of Search ..... 439/571, 567, 439/572, 573, 570, 79, 81, 82, 83, 607, 608, 609, 610

(56) References Cited

U.S. PATENT DOCUMENTS 4,911,659 A * 3/1990 Viselli ..... 439/570
6,024,603 A * 2/2000 Chen et al. ..... 439/571
6,045,401 A * 4/2000 McAlonis ..... 439/567
6,095,853 A * 8/2000 Huang et al. ..... 439/541.5
6,162,091 A * 12/2000 Kurotori et al. ..... 439/567

* cited by examiner

*Primary Examiner*—Gary Paumen
*Assistant Examiner*—Alexander Gilman
(74) *Attorney, Agent, or Firm*—Roger C. Turner

(57) ABSTRACT

A connector is mounted on a circuit board by a pair of elongated fasteners (23) that each have a connector end (29) that is fixed to the connector housing and a board mount end (28) that is fixed in mount holes (80) in the circuit board. The board mount ends of the fasteners are press fit into circuit board holes as the termination ends (42) of the connector contacts are inserted into plated holes in the board. Each fastener is attached to the connector by passing the connector end of the fastener through a hole (24) in a plate-like metal wing (74) of the connector and then press fitting the connector end of the fastener to the wing. The fastener has an elongated pin-like middle portion (26) that can be bent 90° so most of the connector can lie beyond an edge (70, 72) of the circuit board and partly in the plane of the circuit board.

11 Claims, 2 Drawing Sheets

BOARD MOUNTED CONNECTOR

CROSS-REFERENCE

This patent application claims priority from German application 199 45 310.1 filed Sep. 22, 1999.

BACKGROUND OF THE INVENTION

One type of connector is mounted on a circuit board by fasteners that each includes a fixing angle part, a sleeve element axially split at one end, and an internally threaded sleeve. The three components have to be assembled in such a way that the sleeve element is fastened to the fixing angle part and penetrates one end of the latter so its outwardly projecting and axially split end fits in a radially resilient manner into a plated-through hole of a circuit board. Also, it is necessary that the internally threaded sleeve is connected, with the interposition of a connector housing region, by soldering or compression to the other end of the fixing angle. This is costly both in terms of manufacture and assembly. Fasteners of simple construction that were easy to attach to the connector and circuit board, which took up minimum additional space on the circuit board, and which allowed the connector to occupy a minimum region above the upper face of the circuit board, would be of value.

SUMMARY OF THE INVENTION

In accordance with one embodiment of the present invention, single piece fasteners are provided for easily and quickly connecting a connector to a circuit board, that allows the connector to extend only a small distance above the circuit board and which allows the fasteners to occupy only a small additional surface area on the board around plated-through holes that receive contacts of the connector. Just as the terminal ends of the contacts can be terminated to the circuit board by press-fitting them into plated holes in the board, the fasteners can be press-fitted into mounting holes in the circuit board. Also, connector ends of the fasteners can be connected to the connector by press fitting them into holes in the connector. The fasteners can have bent parts that allow the mating direction of the connector to extend at a right angle to the mount ends of the fasteners that plug into the circuit board. The mount ends and most of the lengths of the fasteners can be projected through holes in a plate-like wing on the connector, and the housing ends of the fasteners then can be press fit into the wings.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
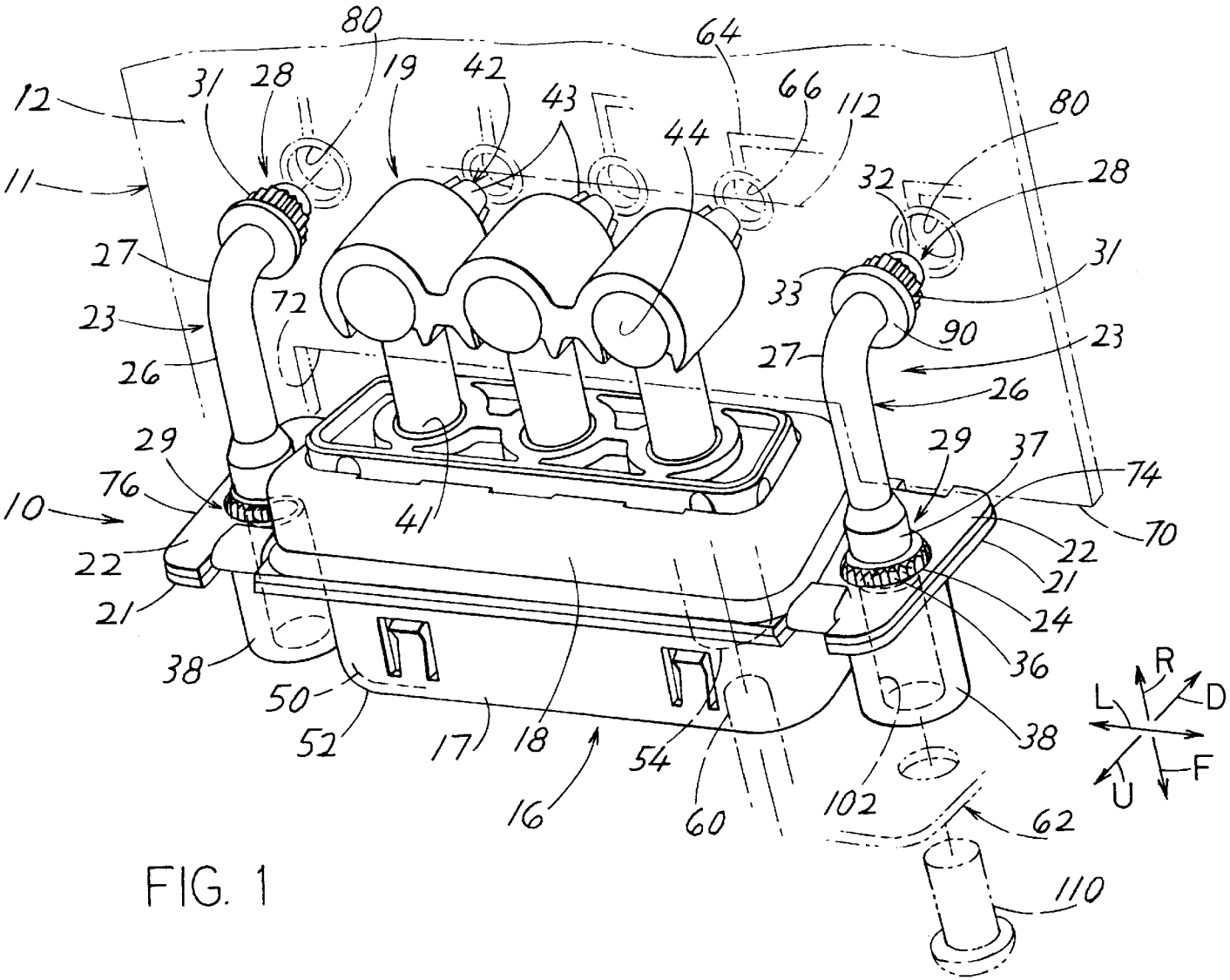
FIG. 1 is an isometric view of the connector of the present invention, shown with a pair of fasteners of the invention mounted thereon, and showing in phantom lines, a circuit board that is not yet connected to the connector and fasteners and also showing a mating connector device that is not yet mated to the connector.

FIG. 1 illustrates a connector 10 which is designed for mounting on a circuit board 11 that has an upper face 12. The connector includes a housing 16 with an insulator 50 and with a shell 52 having front and rear shell portions 17, 18. A plurality of contacts 19 are mounted in the housing insulator and have mating ends 54 and opposite termination ends 42. The mating ends 54 extend in a forward F direction and can mate to contact devices 60 of a mating connector device 62 by moving the ends 54 forwardly F to the contact devices. The termination ends 42 of the contacts extend in a downward D direction toward the circuit board, and are coupled to traces 64 of plated holes 66 in the circuit board by moving the contact termination ends into the plated holes. The circuit board has an edge 70 with a cutout 72, and most of the connector housing lies forwardly beyond the edge at the cutaway 72, so the connector occupies only a small distance above the upper face of the circuit board.

Front and rear directions are indicated by arrows F, R, up and down directions are indicated by arrows U, D, and lateral directions are indicated by arrows L.

The connector is fixed to the circuit board by a pair of fasteners 23. The shell 52 of the housing forms a pair of wings 74, 76, with each wing being formed by sheet metal wing parts 21, 22 of the front and rear shell portions 17, 18. The wing portions are connected to one another by crimping and have drilled holes forming wing holes 24.

Each of the fasteners 23 have pin-like middle regions 27 that are bent, usually at a right angle. The shorter portion beyond the bend forms a board-mount end 28 that is designed to be inserted into a mount hole 80 in the circuit board, which is preferably a plated hole for grounding the shell of the connector. The longer portion of the pin region 26 forms a connector-fixed end or connector end 29 for fixing to the connector, and particularly to the wings 74 of the connector shell.

Figure 2:
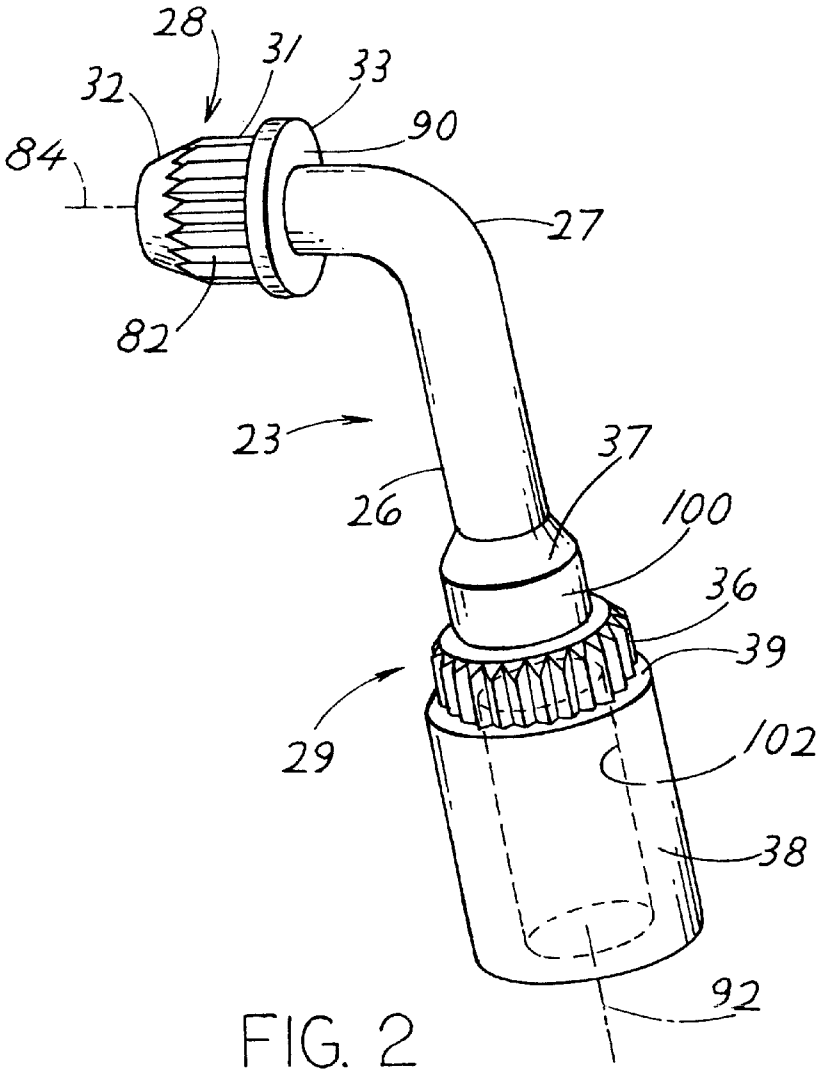
FIG. 2 is an enlarged isometric view of one of the fasteners of the arrangement of FIG. 1.

As shown in FIG. 2, the board-mount end 28 of each fastener has a multiplicity of tapered grooves 82 that extend along a vertical axis 84, and that leave axial teeth 31. The teeth are angled from one another about the axis 84 by no more than 90° and preferably no more than 60°, and have tapered lower ends that merge into a cone 32. The board-mount end 28 of each fastener can be inserted into a mount hole of the circuit board by pressing down against an upwardly-facing surface 90 of a collar 33, with the cone 32 centering the board-mount end in the hole and the teeth 31 lying in a press fit with the walls of the mount hole in the circuit board. With a press fit, the outside diameter of the teeth is slightly greater than the inside diameter of the mount hole, so the teeth cut into the hole for a good electrical and mechanical press fit connection.

The connector-fixed end 29 of each fastener extends along a forward-rearward axis 92. The connector end includes a cone 37 with its large end forward and merging with a cylinder 100, and with a plurality of teeth 36 lying forward of the cylinder. The teeth 36 are of similar construction to the teeth 31 at the other end, with tapered rear ends. A stop 39 lies at the front end of the teeth, and a sleeve 38 with a threaded hole 102 extends forward of the teeth.

Each fastener is initially installed on a connector wing by first inserting the board-mount end and most of the fastener length, rearwardly through a wing hole 24 (FIG. 1). All portions of the board-mount end are of smaller diameter than the hole 24 to easily pass through it. Further rearward insertion of the fastener results in the teeth 36 starting to enter the wing hole 24. The connector-fixed end 29 of the fastener is press fit rearwardly into the wing hole, until a stop 39 (FIG. 2) of the fastener end abuts the wing. In this case, the teeth are not only useful to provide a secure press fit without severe damage to the walls of the wing hole, but also prevent rotation of the fastener about the axis 92. With the two fasteners installed on the wings 74, 76 (FIG. 1), the connector is ready for installation on the circuit board. The terminal ends 42 of the contacts are aligned with the plated holes 66 while the board-mount ends 28 of the fasteners are aligned with the mount holes 80. Then, the terminal ends of the contacts and the board-mount ends of the fasteners are simultaneously pushed downwardly D into the corresponding holes in the circuit board. A special tool can be used for this purpose, that presses against flat surfaces 44 on the contacts that face in an upward U direction and that presses against the faces 90 on the fastener ends. Forces against the fastener push surfaces 90 must be greater than the forces against the contact terminal ends 42 since the terminal ends are split contacts that are readily pressed into the corresponding holes 66.

After the connector is installed, the mating connector device 62 can be mated to the connector and fastened in place by screws 110 that pass through holes in wings of the mating connector device 62 and that are screwed into the threaded holes 102 in the sleeves of the fasteners.

It is noted that the teeth 31 of the board-mount ends of the fasteners lie in about the same plane as slit receiver parts 43 of the contact termination ends. As a result, all contacts and both fastener board-mount ends 28 can be simultaneously inserted into corresponding holes in the circuit board. The mount holes 80 lie near opposite ends of the row of contact-receiving holes 66 and are closer to the row line 112 of the contact-receiving holes than to the edges 70, 72 that the connector housing lies beyond. As a result, the mount holes 80 occupy only a small additional space of the circuit board, with that space lying immediately around the rest of the connector. The row line 112 is also closer to adjacent edges of the mount holes than the diameter of the mount holes, which avoids pull-out of the contact by only tilting of the fastener board-mount ends.

Figure 3:
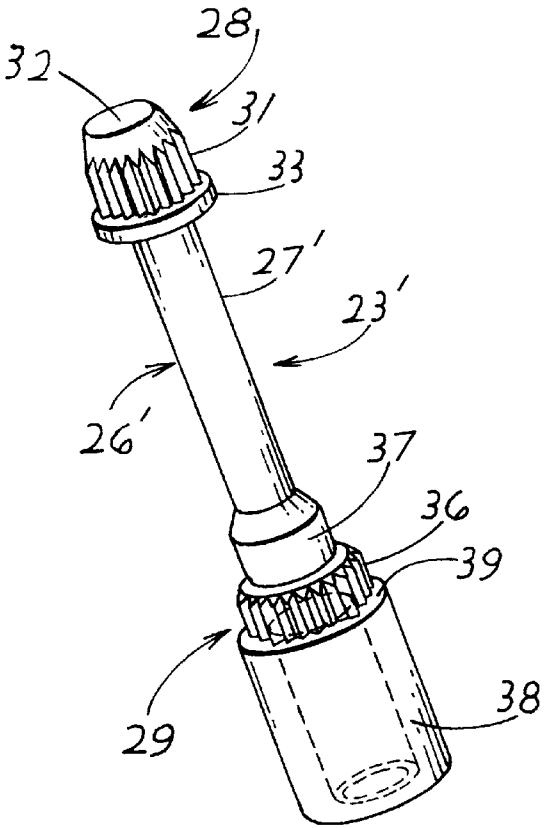
FIG. 3 is an isometric view of a fastener of another embodiment of the invention wherein the fastener is straight instead of bent.

The fastener 23 of FIG. 2 can be formed by machining a metal bar, leaving the elongated pin-like or shaft part 26 in a straight configuration. Then, the shaft 26 is bent at 27. In some cases, a straight shaft such as shown at 27' in FIG. 3 is useful, as where the connector faces upwardly, in the same direction faced by the upper face of the circuit board. In that case, the shaft 27' is not bent. However, the fastener 26' is otherwise of the same construction.

While terms such as "up", "down", etc. have been used to help describe the invention as it is illustrated, it should be understood that the invention can be used in any orientation with respect to the Earth.

Thus, the invention provides a connector that is used in combination with a circuit board, and fasteners that fix the connector to the circuit board, with the fasteners being of simple design, being easily attached to the connector and circuit board, occupying little space and being readily manufactured in either a right angle or straight configuration. One or both ends of the fastener form multiple tapered teeth that can be readily press fitted into a corresponding hole in the circuit board or in a hole of the connector housing. The connector housing includes a metal shell with a plate-like wing forming a hole into which the connector-mount end of the fastener is inserted. The mount-end of the fastener can form a sleeve with a threaded hole to facilitate connection to a mating connector device. The board mount end of each fastener is of smaller diameter than the wing holes, so each fastener can be installed on the connector by slipping the board mount ends and most of the fastener length through the wing holes and then pressing the connector-mount ends in a press fit into the wing holes. Each fastener has an elongated pin-shaped shaft which can be bent for a right angle connection. The board-mount ends of the fasteners lie in about the same plane as the termination ends of the contacts of the connector so all of them can be simultaneously inserted downwardly into corresponding circuit board holes. The mount ends of the fasteners preferably lie substantially in line with a line of a row of contact termination ends so the area occupied by the connector is increased only moderately by the board-mount ends of the fasteners.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector with a housing and a plurality of contacts mounted in said housing, with said contacts each having a mating end for mating to a contact device of a mating connector device and a termination end that extends in a downward direction for insertion into plated holes in a circuit board, where said circuit board has an upper face that faces in an upward direction and has a pair of mount holes, where said contact mating ends face in a forward direction that is perpendicular to said upward direction, and said connector includes a pair of fasteners for fastening said housing to said circuit board, wherein:

said contact termination ends are constructed for downward insertion into said plated holes, each of said fasteners is formed by machining metal and has a pin-like middle portion of substantially cylindrical shape which has been forcefully bent to form a right angle bend, and each of said fasteners has a connector-fixed end that is fixed to said housing and a board mount end that is constructed to press fit into said mount holes of said circuit board.

2. The connector described in claim 1 including said circuit board, and wherein:

said plated holes comprise a plurality of contact-receiving plated holes that lie in a row that extends along a row line that is spaced from said edge;

said row line is closer to an adjacent edge of one of said mount holes than the diameter of the mount hole.

3. The connector described in claim 1 wherein:

said board mount ends of said fasteners each have a vertical axis and multiple axial grooves that leave teeth that are tapered to have narrow radially outer ends, to be easily press fitted into said mount holes of said circuit board, said teeth being fixed together along their entire lengths and rigid so they cannot bend.

4. A fastener for fastening a connector housing that has a connector fastener hole to a circuit board that has a mount hole, comprising:

an elongated pin-shaped shaft having a connector-mount end and an opposite board-mount end, with at least one of said ends having an axis and a plurality of circumferentially-spaced slots extending parallel to said axis and forming tapered teeth for press fit into one of said holes, said teeth being fixed together along their entire lengths and being rigid so they cannot bend.

5. The fastener described in claim 4, wherein:

said connector-mount end forms said fixed teeth;

said board-mount end is of smaller diameter than said connector-mount end, and each end has a push surface for pushing on to press fit the corresponding end into a corresponding one of said holes, with the push surface on said connector mount end lying on a side of said teeth that is opposite said shaft.

6. The fastener described in claim 4 wherein:

said shaft has is formed of machined metal and is pin-shaped and has a 90° bend formed by forcefully bending a straight shaft.

7. A method for mounting a connector on a circuit board, where the connector has a housing with an insulator, said connector having a plurality of contacts mounted in said insulator with said contacts having opposite mating ends and termination ends with said termination ends extending in downward directions, and said circuit board has a plurality of plated contact-receiving holes opening in an upward direction, said contact termination ends having larger initial diameters than said contact-receiving holes so said termination ends can be inserted into said contact-receiving holes only by applying a downward force to said termination end to press fit them into said contact-receiving holes, comprising:

attaching connector-fixed ends of each of a pair of elongated fasteners to said housing, with said fasteners having board mount ends extending in downward directions and requiring downward force to press fit them into said board mount holes;

forming mount holes in said circuit board;

pressing said contact termination ends and said fastener board-mount ends substantially simultaneously downwardly into said plated contact-receiving holes and into said mount holes, to press fit said contact termination ends and said fastener board-mount ends into the corresponding holes.

8. A combination of a circuit board with an upwardly-facing top face and a plurality of a plated contact-receiving holes extending in a row, and a connector with a housing and a row of contacts mounted in said housing, with the contact having a mating end facing in a mating direction and an opposite termination end, said contact termination ends extending in a downward direction for insertion into said plated holes in the circuit board, and the circuit board having a pair of fastener mount holes, comprising:

a pair of elongated fasteners for mounting said housing to said circuit board, with each fastener having a connector-fixed end that is fixed to said housing and a fastener board mount end, with said fastener board mount end lying at opposite ends of said row of contacts and lying at the same height as said contact ends, said fastener board mount ends and said contact termination ends each lying in a press fit in a corresponding one of said holes in said circuit board, so said contact termination ends and said fastener board mount ends can be forcefully inserted together into said holes.

9. The combination described in claim 8 wherein:

said fastener have upwardly-facing flat surfaces lying above said board mount ends and said contacts each has an upwardly-facing flat surface above said contact termination end, so downward forces on said flat surfaces press said board mount ends and said contact termination ends into said holes in said circuit board.

10. The combination described in claim 8, wherein:

said row of contact-receiving holes lies on a row line, and said row line is closer to said mount holes than the diameter of each of said mount holes, to avoid connector tilt when there is greater resistance to pressing said fastener mount into corresponding holes than pressing said contact termination ends into corresponding hole.

11. The combination described in claim 8 wherein:

said board mount ends of said fasteners each have a vertical axis and multiple axial grooves that leave teeth that are tapered to have narrow radially outer ends, to be easily press fitted into said mount holes of said circuit board, said teeth being fixed to one another along their entire lengths and being rigid so they cannot bend so they lock to the circuit board.

* * * * *